United States Patent [19]

Gretler

[11] 4,031,729

[45] June 28, 1977

[54] EMERGENCY KEY MECHANISM ON A CYLINDER LOCK WITH A DOUBLE LOCKING CYLINDER

[75] Inventor: Heinrich Gretler, Hinwil, Switzerland

[73] Assignee: Bauer Kaba AG., Wetzikon, Switzerland

[22] Filed: Sept. 16, 1975

[21] Appl. No.: 613,897

[30] Foreign Application Priority Data

Sept. 26, 1974 Switzerland ..... 012999/74

[52] U.S. Cl. ..... 70/380; 70/398; 70/DIG. 60

[51] Int. Cl.² ..... E05B 17/04

[58] Field of Search ..... 70/380, DIG. 60, 379 R, 70/379 A, 395, 397, 341, 343, 338, 398

[56] References Cited

UNITED STATES PATENTS

| | | | |
|---|---|---|---|
| 36,024 | 7/1862 | Pimentel et al. | 70/397 |

FOREIGN PATENTS OR APPLICATIONS

| | | | |
|---|---|---|---|
| 562,691 | 10/1932 | Germany | 70/DIG. 60 |
| 1,930,739 | 10/1970 | Germany | 70/DIG. 60 |
| 562,341 | 11/1956 | Italy | 70/DIG. 60 |
| 6,701,623 | 2/1968 | Netherlands | 70/380 |
| 397,463 | 2/1966 | Switzerland | 70/DIG. 60 |
| 474,651 | 8/1969 | Switzerland | 70/380 |

*Primary Examiner*—Paul R. Gilliam
*Assistant Examiner*—Kenneth J. Dorner
*Attorney, Agent, or Firm*—Roylance, Abrams, Berdo & Kaul

[57] ABSTRACT

There is disclosed an emergency key mechanism on a cylinder lock with a double locking cylinder and a locking coupling axially moveably fitted thereon. The mechanism comprises a coupling spindle and two coupling wings mounted in a rotary manner thereon for the alternative coupling of a cam for the locking bolt arranged in rotary manner between the two locking cylinders in the center of the stator common thereto to one of the two cylinder rotors by alternative positive locking engagement of one of the two non-rotary coupling wings axially displaceable in the rotors in an opening of the cam web, wherein the two coupling wings are axially displaceable on the coupling spindle and when the locking coupling is in the normal position are axially spaced from one another by a spring positioned on the said coupling, and wherein at least one of the two coupling wings has an operating member, and via the latter is coupleable in the cam web by an operating pin mounted in axially displaceable manner in the shortened key blade of an emergency key.

10 Claims, 15 Drawing Figures

EMERGENCY KEY MECHANISM ON A CYLINDER LOCK WITH A DOUBLE LOCKING CYLINDER

BACKGROUND OF THE INVENTION

The present invention relates to an emergency key mechanism on a cylinder lock with a double locking cylinder and a locking coupling axially movably fitted therein. The mechanism comprises a coupling spindle and two coupling wings mounted in rotary manner thereon for the alternative coupling of a cam for the locking bolt arranged in rotary manner between the two locking cylinders in the center of the stator common thereto to one of the two cylinder rotors by alternative positive locking engagement of one of the two non-rotary coupling wings axially displaceable in the rotors in an opening of the cam web.

Emergency key mechanisms of this type are already known.

As is known, cylinder locks with double locking cylinders can exercise three different locking functions which will briefly be explained hereinafter.

With the simplest type of double locking cylinder, the door can at any time and without hindrance be opened or closed or locked or unlocked with the appropriate key from one or the other side. Thus, the private sphere, e.g., a hotel room or the inside of a dwelling is not protected.

As a further development of this locking function, a second locking function is obtained through incorporating a locking coupling between the rotors of the two locking cylinders. In this case, when a key is inserted or turned in the door from the inside, e.g., the inside of a dwelling, the door can no longer be opened from the opposite side, i.e., from the outside, so that the private sphere is protected.

However, these two locking functions, i.e., possible access from both sides at all times and the protection of the private sphere are not sufficient in old people's and convalescent homes, hospitals, clinics, old people's dwellings, hotels, etc. In such cases, it is necessary on the one hand to protect the private sphere, e.g., in an old people's home or hotel room, but on the other hand, it must be possible in an emergency, e.g., fire, flood, risk of death in the case of illness, etc. to open the locked door from the outside. It is intended that these two conditions should be fulfilled by the emergency key mechanism.

A disadvantage of the hitherto known emergency key mechanisms on a cylinder lock with double locking cylinders is that when changing the emergency status, e.g., on changing from an emergency function on one side to such a function on both sides, or for locking-technical reasons, the whole cylinder must be replaced so that prior planning is necessary which is, however, always linked with planning uncertainty. However, present day security consciousness and the dynamics of organization programs in factories and businesses require constant adaptation of the locking arrangements to the particular requirements even during the actual construction work, so that cylinders have to be modified and replaced and this always affects the emergency key mechanisms. It would therefore be advantageous if the emergency status of the cylinder could be achieved by merely replacing parts.

A further disadvantage of the known emergency locking mechanisms is that the emergency key could be made relatively easily from a normal key by filing away and the like.

BRIEF SUMMARY OF THE INVENTION

An object of the present invention is to obviate these disadvantages of the prior art.

In the emergency key mechanism according to this invention, the two coupling wings are axially displaceable on the coupling spindle and when the locking coupling is in the normal position and are axially spaced from one another by a spring positioned on the said coupling, and wherein at least one of the two coupling wings has an operating member, and via the latter is coupleable in the cam web by an operating pin mounted in axially displaceable manner in the shortened key blade of an emergency key.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof, and what are now considered to be the best modes contemplated for applying these principles. Other embodiments of the invention embodying the same or equivalent principles may be used and structural changes may be made as desired by those skilled in the art without departing from the present invention and the scope of the appended claims.

The invention will be described by reference to the following drawings wherein.

DETAILED DESCRIPTION OF THE PREFERRED EMBODIMENTS

Figure 1:
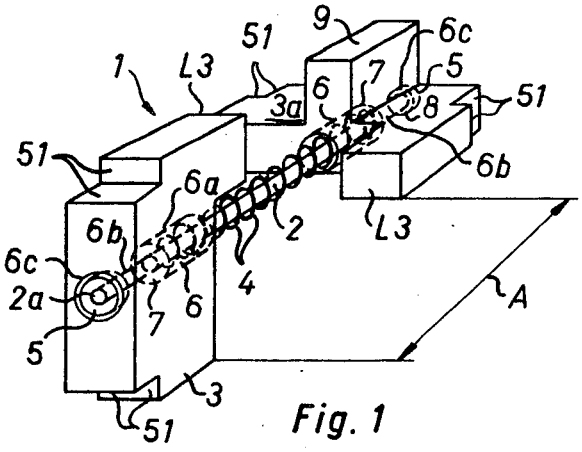
FIG. 1 is a three-dimensional view of the locking coupling of the emergency key mechanism of a cylinder lock with double locking cylinder according to FIG. 4.
Figure 4:
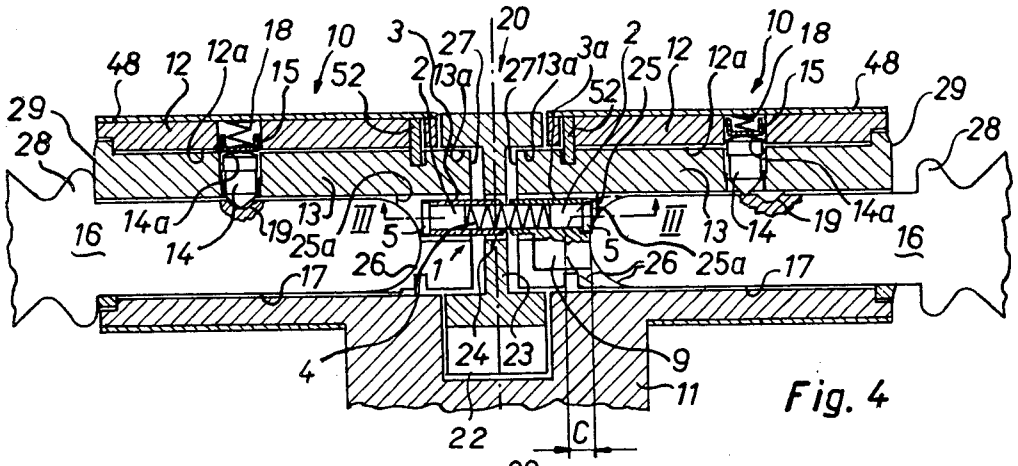
FIG. 4 is a vertical longitudinal section of the double locking cylinder of a cylinder lock with an emergency key mechanism and normal keys inserted on both sides in the withdrawal position.

In FIG. 1 a locking coupling of the type incorporated in a cylinder lock with double locking cylinder according to FIG. 4 comprises a rigid coupling spindle 2 of predetermined length, two flat coupling wings 3 and 3*a*, as well as a coupling spring 4 constructed as a helical spring arranged between the two said wings. The two coupling wings 3 and 3*a* which differ from one another only in that coupling wing 3*a* is provided with an operating member 9 necessary for the emergency function and whose purpose and operation will be explained hereinafter are mounted in axially displaceable and rotary manner on coupling spindle 2. Coupling spring 4 which acts as a compression spring is also mounted on coupling spindle 2, i.e., it is loosely placed thereon with a radial tolerance and spaces the two coupling wings 3 and 3*a* from one another in a predetermined reciprocal spacing A. At each of its two ends, the coupling spindle 2 has a head 5 of relatively limited length and somewhat increased diameter which serves as a stop for the coupling wing 3 or 3*a* associated therewith, i.e., it limits the axial displacement path outwards thereof on the coupling spindle 2. The coupling spring 4 fitted with slight pretension maintains the two coupling wings 3 and 3*a* spaced from one another with spacing A, i.e., it presses these outwardly against the two spindle heads 5 for as long as no axial external forces act on the coupling wings 3 and 3*a*. Thus, in the position of the locking coupling 1(cf. FIG. 1) the spacing A between the two coupling wings 3 and 3*a* engaging on spindle heads 5 is at a maximum. Whereas the shaft of coupling spindle 2 has the same diameter between the two spindle heads 5, i.e., has no interruption, the horizontal through-bores designated by the reference numeral 6 in FIG. 1 of the two coupling wings 3 and 3*a* are in each case interrupted at two points. An internal bore portion 6*a* of larger diameter in conjunction with the smooth shaft of coupling spindle 2 forms a cylindrical reception zone for the coupling spring 4 which moves freely therein as well as of vertical circular stop face 7 for the same. A narrower bore portion 6*b* of coupling wing 3 or 3*a* located further outwards and adjacent to bore portion 6*a* forms the actual bearing for coupling wing 3 or 3*a*, and at the same time serves as a guide for its axial displacement on coupling spindle 2, while a relatively short bore portion 6*c* located still further to the outside whose internal diameter is once again somewhat larger than the central bore portion 6*b* receives spindle head 5 and simultaneously forms a vertical circular opposite stop face 8 for the same, whereby the outer end face of spindle head 5 and that of coupling wing 3 or 3*a* are located in a common vertical plane.

The prismatic operating member 9 necessary for the emergency function is according to FIG. 1 arranged in the center of coupling wing 3*a*, i.e., in the axial plane of coupling spindle 2 perpendicular to coupling wing 3*a* and is rigidly connected with coupling wing 3*a*, e.g., is welded or soldered thereto. However, operating member 9 can also be milled out of the whole part on coupling wing 3*a*.

To be able to mount the two coupling wings 3 and 3*a* as well as the coupling spring 4 on coupling spindle 2, one of the two spindle heads 5 can be fitted to spindle 2 only after the said three components have been placed thereon, whereas the other of the two spindle heads 5 can be fitted to spindle 2 beforehand. Thus, for example, one of the two spindle heads 5 can be circular and riveted to the coupling spindle 2 as indicated to the left in FIG. 1 by 2*a*.

According to FIG. 1 the two coupling wings 3 and 3*a* are asymmetrical, i.e., substantially angular, whereby they, in each case, have on one side a lug-shaped attachment L3 which performs the actual coupling function as will be explained herein-after relative to FIGS. 3 and 4. Recesses 51 are provided on the outer end of coupling wings 3 and 3*a* to prevent striking of the coupling wing on the rotor mounting (cf. 52 in FIG. 4) on rotating the coupling wing using an emergency key shorter than the normal key 16.

Figure 1A:
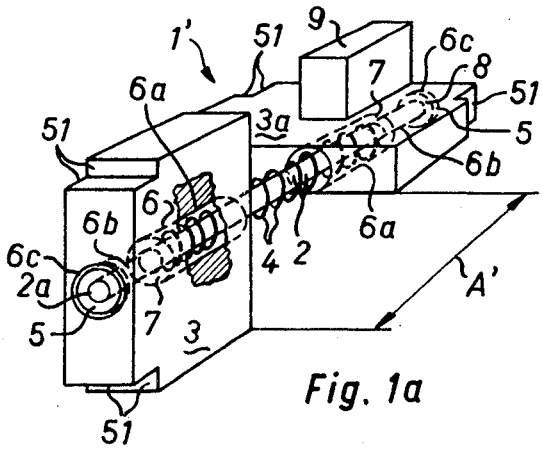
FIG. 1*a* is a three-dimensional view of another construction of the locking coupling.

FIG. 1*a* shows another construction 1′ of the locking coupling. In this case the two coupling wings 3 and 3*a* are symmetrical, i.e., are substantially rectangular without inwardly projecting coupling lugs on one side, whereby the inner wing portions exert the actual coupling function over their entire width extending at right angles to the coupling spindle 2 as will be explained relative to FIG. 3.

Figure 2:
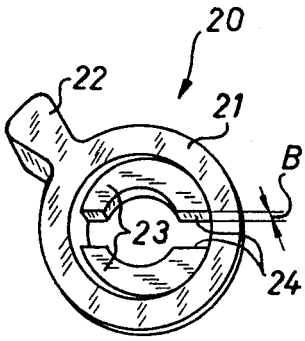
FIG. 2 is a three-dimensional view of the double locking cylinder cam according to FIG. 4.
Figure 5:
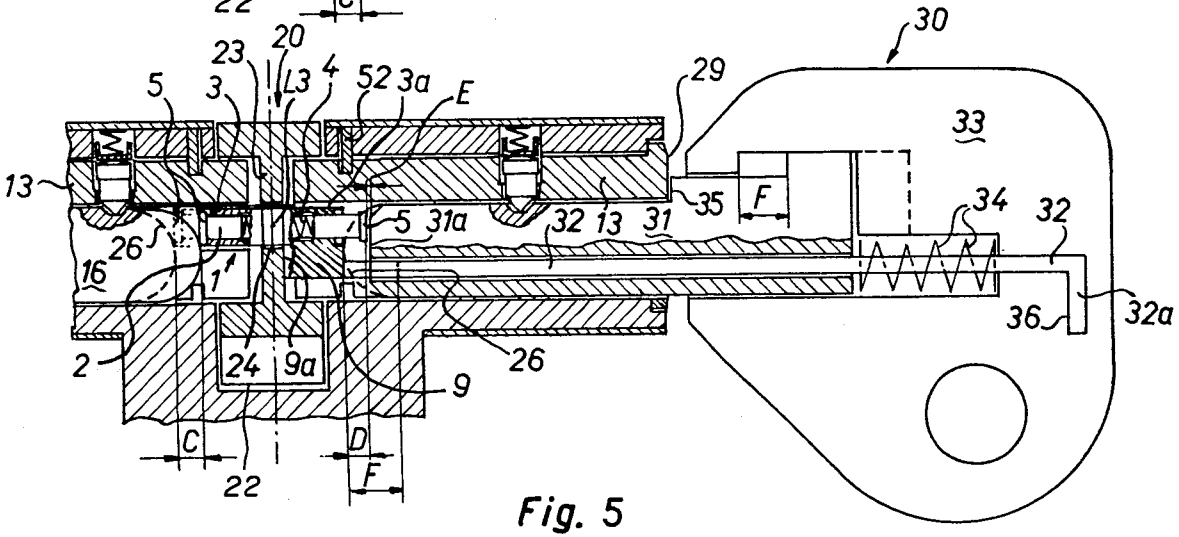
FIG. 5 is a vertical longitudinal section of the double locking cylinder of FIG. 4 with an emergency key and normal key in the withdrawal position.

In a three-dimensional view, FIG. 2 shows a cam 20 for the lock bolt of the cylinder lock with double locking cylinder according to FIGS. 4 and 5. The cam 20 has a circular face 21 with an outwardly projecting locking nose 22 for operating the lock bolt as well as a central web 23 of width B which is, as can be gathered from FIGS. 4 and 5, positioned in rotary manner between the two locking cylinders 10 in the center of stator 11 which is common thereto as will be explained in greater detail hereinafter relative to FIG. 4. Cam web 23 is provided with a window-like opening 24 of substantially rectangular shape which engages in positive locking manner one of the two coupling wings 3 and 3*a* of locking coupling 1 or 1′, i.e., when using exclusively normal keys 16 (cf. FIG. 4), either the left-hand coupling wing 3 or the right-hand coupling wing 3*a* (cf. FIG. 4). Cam 20 is in one piece and can be produced as e.g., a pressure casting or high quality casting. The locking nose 22, which on rotating cam 20 operates the lock bolt of the cylinder lock, i.e., depending on the rotation direction is extended into its locking position or is inserted in the door, is cast on the outer cam face 21.

Figure 3:
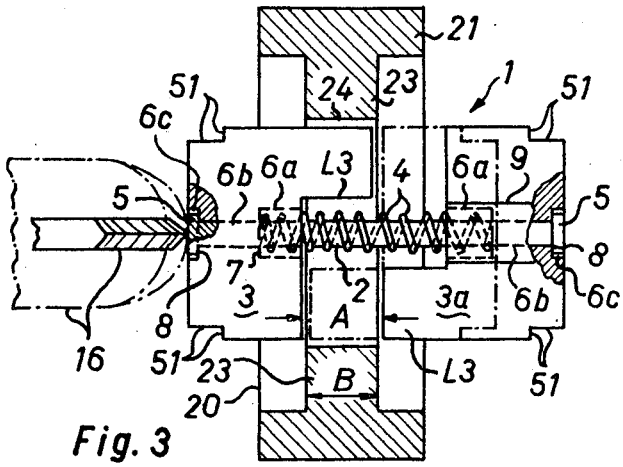
FIG. 3 is a locking coupling according to FIG. 1 with the cam in the coupling position according to FIG. 4 in a horizontal axial view through the cam along the line III—III of FIG. 4.

FIG. 3 shows the locking coupling 1 of FIG. 1 with cam 20 to the left in engagement on the side with the inserted normal key 16 (cf. also FIG. 4) when viewed from bottom to top. As the left-hand coupling wing 3 has no operating member, on assembling locking coupling 1 with cam 23 it can be completely passed through opening 24 of cam web 23 so that on installing the finally assembled locking coupling 1, it can without difficulty be inserted as a whole in cam 20.

In the coupling position for normal operation of the lock as shown in FIG. 3, the pressure of normal key 16 which is completely inserted to the left on spindle head 5 of coupling spindle 2, causes locking coupling 1 to be as a whole displaced to the right. Thus, the coupling lug L3 of the left-hand coupling wing 3 can be entirely inserted into cam web 23 while the right-hand coupling wing 3a, held at a distance A from the left-hand coupling wing 3 by the tension of spring 4 is uncoupled from cam web 23, i.e., its coupling lug L3 is entirely moved out of web opening 24.

For the emergency function of the cylinder lock in FIG. 3, the right-hand coupling wing 3a equipped with the operating member 9 is shown by dotted lines. This shows that although the left-hand coupling wing 3 with its coupling lug L3 is entirely coupled, the emergency-side right-hand coupling wing 3a with its coupling lug L3 can also be entirely coupled into cam web 23. Thus, both coupling wings 3 and 3a can be simultaneously inserted in cam web 23 to a depth equal to web width B. Thus, the essential requirement for the operation of the emergency key mechanism in the double locking cylinder that in an emergency both coupling wings 3 and 3a simultaneously engage in the web 23 of cam 20 is fulfilled. Thus, for example, if a hotel room door has been locked from the inside by turning the normal key 16 inserted to the left, e.g., by approximately 90° into the position shown in FIG. 3 by dotted lines, in an emergency situation the emergency-side right-hand coupling wing 3a can also be entirely coupled into the cam web 23 by means of an emergency key inserted to the right (30 in FIG. 5) and by turning the emergency key the door can be unlocked and opened as will be explained in greater detail relative to FIG. 5.

Instead of the locking coupling 1 of FIG. 1 with asymmetric coupling wings i.e., with coupling lugs L3 arranged on one side and inserted into the cam web 23 by the entire web width B, correspondingly locking coupling 1' according to FIG. 1a with symmetrically constructed coupling wings can be inserted into cam 20. Then, however, each of the two coupling wings 3 and 3a is inserted into cam web 23 to a depth equal to only half the web width B. Although the locking coupling 1 with asymmetrical coupling wings shown in FIGS. 1 and 3 requires double the trouble of the operating pin (cf. 30 with 32 in FIG. 5) incorporated in emergency key 30 as compared with the locking coupling 1' of FIG. 1a, it is much more reliable in operation because any tolerance errors which may occur thereon due to the manufacturing process have substantially no influence on the operational reliability of the coupling and uncoupling of cam 20.

In FIG. 4, two identical locking cylinders 10 of normal length are arranged on a common carrier or stator 11. Each of the two locking cylinders 10 substantially comprises a stationary cylinder casing 12 and a cylinder rotor 13 which rotates therein but is mounted in axially non-displaceable manner and includes the incorporated pairs of tumbler pins. In the vertical longitudinal section of FIG. 4 only one pair of tumbler pins 14 and 15 associated with the back of the key is shown. Two normal keys 16 constructed as turning keys are inserted in the key grooves 17 of the two rotors 13 and are both located in the withdrawal position. While the left-hand key 16 is wholly inserted and consequently the left-hand rotor 13 has become rotatable due to the pair of tumbler pins 14 and 15 loaded by pin springs 18, i.e., after the lower pins 14 thereof have engaged in the appropriate key depressions 19, the right-hand key is located in the half-withdrawn position in which the right-hand rotor 13 cannot rotate. A cylindrical sleeve 48 is placed on the cylinder casing 12 and holds the upper pins 15 of the pairs of tumbler pins 14 and 15 in the latter, whereby it simultaneously forms the abutment for the pin springs 18.

According to FIG. 4, cam 20 is arranged between the two locking cylinders 10 in the center of stator 11 which is common thereto, and is mounted in rotary but axially undisplaceable manner on the terminal portions 13a of the two rotors 13 projecting inwardly from the cylinder casings 12. At least one of the two coupling wings 3 and 3a of the locking coupling always engages in positive locking manner in the window-shaped opening 24 of the cam web 23, i.e., either the left-hand or right-hand coupling wing when only normal keys 16 are used. In the locked position shown in FIG. 4, only the left-hand coupling wing 3 engages in the web opening 24 so that cam 20 is coupled via locking coupling 1 to the left-hand rotor 13 which is now able to rotate.

A rotor mounting 52 engages from above in cylinder rotor 13 in order to prevent an axial displacement of rotor 13 relative to cylinder casing 12. If the right-hand key 16 were shortened as occurs for the emergency key (cf. 30 in FIG. 5), then on turning rotor 13, the right-hand coupling wing 3a would project relative to rotor mounting 52 if the coupling wing was not provided with corresponding recesses 51.

Instead of the normal conventional locking coupling with only rotary coupling wings, here the locking coupling 1, explained in greater detail relative to FIG. 5, having both rotary and axially displaceable coupling wings 3 and 3a is loosely and axially displaceably inserted between the two locking cylinders 10, whereby the two coupling wings 3 and 3a, as in the case of the conventional locking coupling, engage in positive locking manner in the slot-like recesses 25 of the two rotors 13 extending in perpendicular manner to the key groove 17. Here again the locking coupling 1, in the same way as the conventional locking coupling, serves for the alternate coupling of one of the two rotors 13 to cam 20 in order to operate the locking bolt via the locking nose 22 of the cam 20 (cf. FIG. 2). When using the normal key 16, here again locking coupling 1 is always moved as a whole axially to the right or left because rounded front end face 26 in FIG. 4 of normal key 16 presses against the particular spindle head 5 of the rigid coupling spindle 2 during the insertion process and consequently displaces the entire locking coupling 1 in front of it unless the said coupling is still in the coupling position necessary for operating the particular locking cylinder 10 as a result of a previous locking process.

If only the normal keys 16 are used, the various locking positions or functions are here again the same as with the conventional locking coupling with only rotary coupling wings. Thus, e.g., in the position shown in FIG. 4, by turning the wholly inserted left-hand key 16, the door can be locked or unlocked although the right-hand rotor 13 is blocked, i.e., non-rotatable with the right-hand key 16 half-withdrawn. The reason is that the right-hand coupling wing 3a does not engage in cam web 23 when the whole locking coupling 1 is displaced to the right. In the position according to FIG. 4, it would also be possible, for example, for the half-withdrawn right-hand key 16 to be wholly inserted as shown by a dotted line for the front key end face 26 of the said key in FIG. 4, whereby the right-hand rotor 13 which is consequently able to rotate is coupled to cam 20 and can then be turned by means of the right-hand key 16 and the door can be locked or unlocked. Through the pressure of its front end face 26 on the right-hand spindle head 5 the right-hand key 16 moves the whole locking coupling 1 in front of it to the left, i.e., without displacing its two coupling wings 3 and 3*a* on coupling spindle 2, whereby the right-hand coupling wing 3*a* is coupled into the cam web 23 and simultaneously, while maintaining the maximum wing spacing A through coupling spring 4, the left-hand coupling wing is uncoupled from cam web 23. Furthermore and simultaneously, the whole inserted left-hand key 16 which is, however, located in the withdrawn position is moved to the left from the left-hand spindle head 5 of the wholly left-moving locking coupling 1, just as with a conventional locking coupling, by a distance corresponding to the residual insertion path C of the right-hand key 16, whereby it reaches a position corresponding to the position shown in FIG. 2 for the half-withdrawn right-hand key 16, and whereby locking coupling 1 is wholly moved to the left by distance C.

Correspondingly and conversely in FIG. 4, with the complete insertion of the left-hand key 16, the wholly inserted right-hand key 16 located in the withdrawal position could, via the wholly right-moving locking coupling 1, be moved to the right by the same distance C into the half-withdrawn or only partly inserted position shown in FIG. 4, unless it was previously already in this position. The length of the axial displacement path C of locking coupling 1 wholly displaced to the right or left can be substantially gathered from the maximum reciprocal spacing A of the two coupling wings 3 and 3*a*.

The vertical end face 25*a* of the slot-like recess 25 for receiving coupling wing 3*a* or 3 opening out onto the inner vertical end face 27 of the right-hand and left-hand rotor 13 is externally set back somewhat relative to its axial vertical position. Thus, with the complete insertion of the normal key 16 into the particular opposite rotor 13, the reliable abutment of the stop nose 28 provided on the key grip against the outer vertical end face 29 (FIG. 4) of rotor 16 is ensured, i.e., so that during the insertion process the locking coupling 1 which is wholly concomitantly displaced by normal key 16 does not, for example, previously strike by means of its preceding spindle head 5 against the vertical end face 25*a* of recess 25 in the other rotor 13, which would make impossible the complete insertion of key 16 in the particular opposite rotor 13.

If, however, the wholly inserted left-hand key 16, which according to FIG. 4 is still in the withdrawal position, is only turned to a certain extent, it can no longer be withdrawn because the lower pins 14 of the left-hand rotor 13 can no longer be raised from the depressions 19 of the left-hand key 16, but instead, during the attempted withdrawal, strike by their upper end face 14*a* against the wall surface of bore 12*a* against the wall surface of bore 12*a* in cylinder casing 12 for rotor 13. Thus, in this position the right-hand key could no longer be wholly inserted and turned, i.e., to operate the lock bolt because it could then no longer displace to the left the opposite left-hand key via locking coupling 1. Thus, if the left-hand opposite key 16 is inserted and turned to a certain extent, e.g., within a dwelling, the private area within the dwelling is secure, as with the cylinder lock in a conventional locking coupling, i.e., an attempt from the right, that is from the outside, e.g., from a corridor, to unlock and open the dwelling door with an appropriate normal key 16 would be in vain in this situation.

All the above described locking positions and situations and their effects could occur in the same way when using the conventional locking coupling having only rotary, i.e., not also axially displaceable coupling wings. To this extent the purpose, function, and operation of locking coupling 1 which can only be moved as an entire unit and the conventional locking coupling are the same. The previously mentioned operating member 9 (cf. FIGS. 1, 3 and 4) which is not provided on the conventional locking coupling was not used in the locking situations described herein-before. It is only used in conjunction with a special emergency key if an emergency situation or a catastrophe occurs, e.g., a house fire, flood, earthquake, danger of death in the case of illness, general panic etc., i.e., when privacy can and should no longer be maintained. However, the exclusive use of normal keys 16 does not take adequate account of such emergency situations due to the lack of access to the dwelling when a key has been inserted and turned from the inside. Hereinafter emergency keys and situations will be explained in greater detail.

In FIG. 5, in place of the right-hand normal key 16 an emergency key 30 (cf. also FIGS. 6 and 7) is wholly inserted into the right-hand cylinder rotor 13 whereby it is located in the withdrawal position. As in FIG. 2, the opposite normal key 16 wholly inserted into the left-hand rotor 13 is also in the withdrawal position. Unlike normal key 16, emergency key 30 is not constructed as a turning key i.e., is not invertable. Furthermore, the emergency key 30 which is generally used, e.g., in old people's homes, hospitals, hotels etc., is a specially constructed master key which can only be used from the outside, i.e., from the so-called emergency side, e.g., from a corridor.

Figures 6, 7, 8, 9, 10, 11, 12, 13, 14:
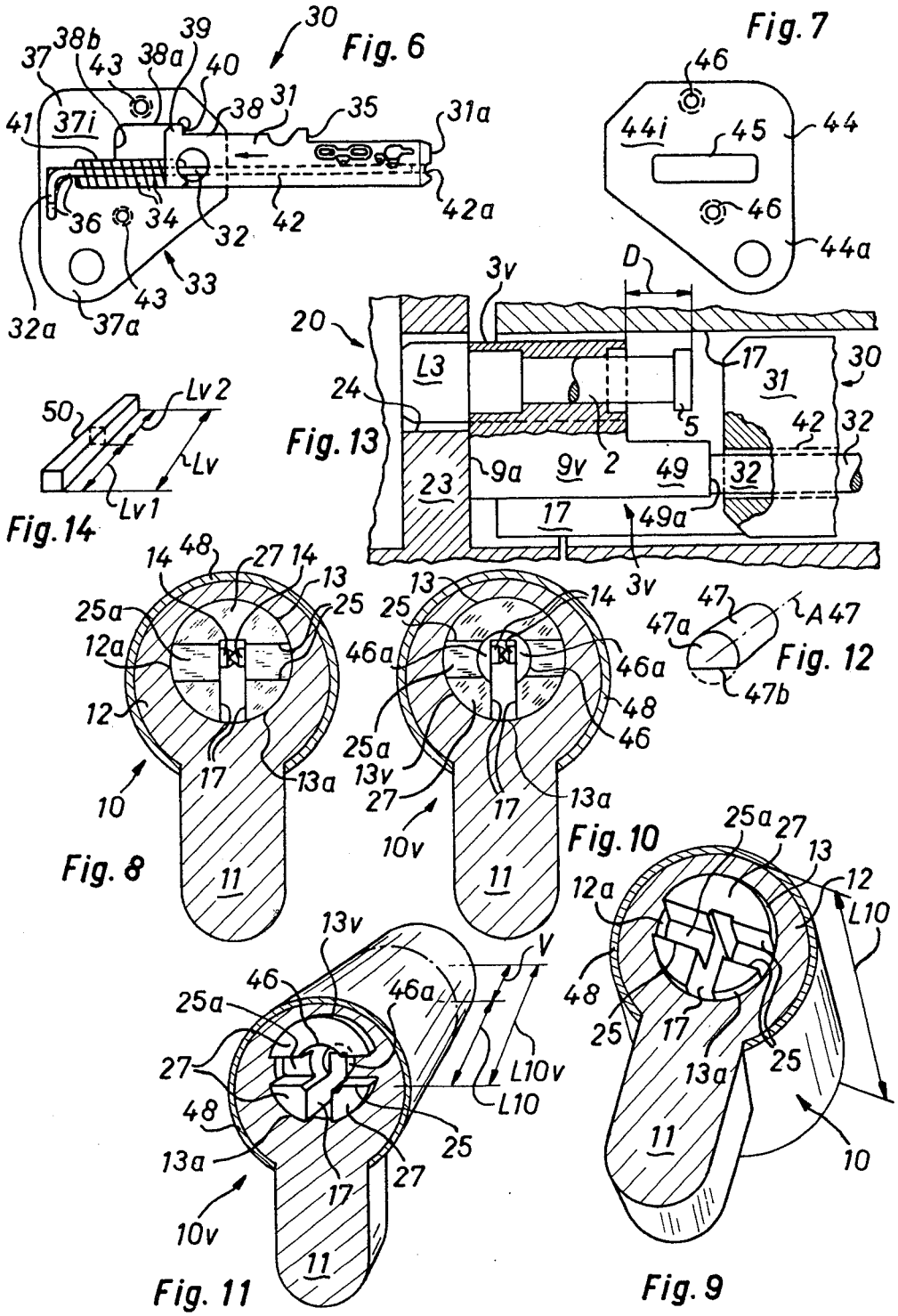
FIG. 6 shows the emergency key of FIG. 5 after disassembly of the key grip covering half in plan view on the inside of the key grip housing half.
FIG. 7 shows the key grip covering half of the emergency key of FIG. 6 in plan view on the inside thereof.
FIG. 8 shows a cylinder of the double locking cylinder according to FIGS. 4 and 5 in plan view on the inner rotor end.
FIG. 9 shows the cylinder according to FIG. 8 represented three-dimensionally.
FIG. 10 shows a locking cylinder extended at one end in a plan view on the inner rotor end.
FIG. 11 is a three-dimensional view of the extended cylinder of FIG. 10.
FIG. 12 is a three-dimensional view of an extension portion for the locking coupling spindle of FIG. 1 and the extended cylinder according to FIGS. 10 and 11.
FIG. 13 shows an emergency-side coupling wing with extended operating slide for the locking coupling of FIG. 1 and the extended cylinder of FIGS. 10 and 11 in plan view partly in vertical section.
FIG. 14 is a three-dimensional view of a loose extension portion for the operating member of the emergency-side coupling wing of the locking coupling of FIG. 1 and the extended cylinder according to FIGS. 10 and 11.

The emergency key 30 substantially comprises a separately constructed key blade 31, a key pin 32 which is axially displaceable therein, a key grip 33 displaceably mounted on blade 31 and a key spring 34 constructed as a helical spring and acting as a compression spring (cf. also FIGS. 6 and 7).

The key blade 31 is somewhat shorter than that of the normal key 16, i.e., its length is shorter than the normal key 16, at least by the operating patch C of locking coupling 1. As a result, the emergency key 30 can also be wholly inserted and can be turned together with the right-hand rotor 13 which, as a result, becomes free if for ensuring privacy the left-hand opposite key 16 has also been wholly inserted within the dwelling or hotel room. However, it cannot be withdrawn by turning and therefore the locking coupling 1 can no longer be moved as a whole to the left.

If, within a dwelling, i.e., a normal key 16 is wholly inserted and turned to the left, the emergency key 30 is wholly inserted from the right as in FIG. 5, i.e., on the emergency side. Not only can the right-hand rotor 13 rotate as a result of recesses 51, but also through the left moving operating pin 32 which thereby presses onto the operating member 9, the right-hand coupling wing 3*a* is axially displaced to the left onto the fixed spindle 2 of locking coupling 1 which has remained wholly stationary counter to the tension of coupling spring 4, whereby coupling wing 3*a* engages in positively locked manner in the opening 24 of cam web 23, thereby coupling cam 20 to the right-hand rotor 13. On inserting the emergency key 30, as soon as key blade 31 with its stop face 35 strikes against the outer vertical end face 29 of the right-hand rotor 30, i.e., when key blade 31 is wholly inserted under normal insertion pressure, the key grip 33 and operating pin 32 move further to the left counter to the pressure of key spring 34 inserted with a certain pretension in key grip 33. The reason is that operating pin 32 has at its outer end a tappet 32*a* which is inserted in form-locked manner in a corresponding recess 36 of key grip 33 so that operating pin 32 participates in the further leftward movement of key grip 33. The pretension of key spring 34 is, on the one hand, both sufficiently large that the insertion process for key blade 31 remains substantially uninfluenced by the displaceability of key grip 33 on key blade 31, but, on the other hand, is sufficiently small that on inserting the emergency key 30 under moderate pressure, i.e., scarcely varying from the insertion pressure of a normal key 16 on key grip 33, the operating pin 32, without any special action of the person operating it, is automatically moved out of key blade 31 to the left as soon as the latter is wholly inserted, i.e., engages with the stop face 35 on the outer rotor end face 29. Thus, both the insertion movement of key blade 31 and the removal movement of operating pin 32 during a completely normal insertion operation take place as with a normal key 16, whereby it is unimportant whether the removal of operating pin 32 from key blade 31 is started during the insertion movement of the said blade 31 or is performed to a greater or lesser extent.

If normal key 16 which is inserted at the left is turned to a certain extent, web opening 24 is also located in a corresponding inclined position so that the right-hand coupling wing 3*a* on the emergency side is brought into engagement with cam web 23 by pressure on key grip 33 and simultaneously turning, whereby grip 33 is turned until coupling wing 3*a* finds the opening 24 in web 23.

When the wholly inserted emergency key 30 is turned, simultaneously cam 20 coupled to the right-hand rotor by the extended operating pin 32 and coupling wing 3*a* which is displaced to the left at the same time is also rotated, thereby unlocking the locked door. This is possible even if the left-hand opposite key 16 is inserted from inside the dwelling and is turned somewhat for ensuring privacy, whereby it is unimportant for the unlocking process that on rotating the right-hand rotor 13 by means of emergency key 30 the left-hand rotor together with the inserted normal key 16 is also rotated, because its coupling wing 3 also is or remains coupled in cam web 23 after locking coupling 1 has as a whole been displaced to the right by the wholly inserted left-hand opposite key 16 and after the turning thereof can no longer be moved back to the left, which would not in fact be possible any way due to the size reduction of emergency key 30. It should be noted that when using normal key 16 locking coupling 1 is only displaced as a whole by distance C (cf. FIG. 4), whereas when using emergency key 30 only its right-hand coupling wing 3*a* alone is moved by an engaging path D (cf. FIG. 5) on the stationary coupling spindle 2. Thus, e.g., in the position according to FIG. 5, the wholly inserted left-hand normal key 16 which is still, however, in the withdrawal position is not moved to the left over the wholly left-moving locking coupling 1 on inserting emergency key 30 as would be the case if instead of emergency key 30 a normal key 16 was wholly inserted to the right as shown by dotted lines in FIG. 5 relative to the left-hand spindle head 5 displaced to the left and the rounded front end face 26 of the left-hand normal key 16 engaging therewith and also shown in dotted lines, whereby also the rounded front end face 26 for a wholly inserted right-hand normal key 16 is also shown be dotted lines. On inserting emergency key 30 only the right-hand emergency side coupling wing 3*a* is alone displaced to the left by engaging path D solely from removed operating pin 32 on the stationary coupling spindle 2, whereby it is unimportant whether or not to the left, i.e., inside the dwelling the normal key 16 has been wholly inserted, half-withdrawn or turned.

To ensure that the key blade 31 of emergency key 30 can be wholly inserted or the emergency key can be turned, a limited safety gap E is provided between the outer vertical end face of the emergency-side right-hand spindle head 5 of the coupling spindle 2 moved to the right and the front end face 31*a* of the wholly inserted key blade 31, preventing with the left-hand normal key 16 wholly inserted and turned the front end face 31*a* of key blade 31 striking against the emergency-side spindle head 5 of the coupling spindle 2 which is then not displaceable to the left on inserting the emergency key 30, which could under certain circumstances make impossible the complete insertion of emergency key blade 31 and therefore the rotation of the emergency-side rotor 13 necessary for operating emergency key 30. The reason is that a simultaneous striking of key stop face 31*a* against the outer rotor end face 29 and the front key blade end face 31*a* against the emergency-side spindle head end face of coupling spindle 2 which cannot be displaced to the left with the opposite key 16 inserted and turned would be equivalent to an inadmissible and so-called redundancy of the insertion limitation for emergency key 30 which would at least make uncertain the complete insertion of emergency key 30 which is absolutely necessary for satisfactory operation and must therefore be avoided in connection with an emergency key.

The operating member 9 which serves for the displacement of the emergency-side coupling wing 3*a* by emergency key operating pin 32 is also used as a longitudinal stop for the said coupling wing to pervent its engaging over the opposite rotor 13. This longitudinal stop is obtained in that the left-moving coupling wing 3*a* strikes against the cam web 23 with its front end face 9*a* of its operating member 9 so that the axial engaging path D of the emergency-side coupling wing 3*a* is limited (FIG. 5).

FIG. 6 shows the emergency key 30 after disassembly of the key grip covering half (cf. FIG. 7). The key blade 31, key spring 34 and operating pin 32 are inserted in a key grip housing half 37 of the two-part key grip 33 of emergency key 30. In a flat recess 38 of housing half 37 is displaceably mounted key blade 31, whereby the displacement is axial in the direction of the arrow to the left, i.e., in a rearward direction counter to the tension of key spring 34. When the emergency key 30 is not inserted, key blade 31 engages by means of a stop nose 39 on a step face 40 of grip housing half 37, whereby face 40 is formed at the transition point between recess 38 and a widened but equally deep recess portion 38*a* facing recess 38. Key spring 34 rests in a semi-cylindrical recess 41 which from the inner surface 37*i* of grip housing half 37 extends somewhat further downwards than the recess 38/38*a* for key blade 31. Operating pin 32 is axially displaceably mounted in a longitudinal bore 42 of key blade 31. The tappet 32*a* of operating pin 32 inserted in form-locked manner in recess 36 of grip housing half 37 is here formed in extremely simple manner in that the operating pin 32 made from heat-treated steel with a thickness of e.g., 1.3 mm is at its rear end bent downwards by 90° (cf. also FIG. 5); thus, operating pin 32 is not axially displaceable relative to housing half 37 and therefore also relative to the whole two-part key grip 33. FIG. 6 shows that the key blade 31 can be axially displaced in grip housing half 37 rearwards in the direction of the arrow until it strikes against a rear surface 38*b* of the widened recess portion 38*a*, this taking place counter to the tension of the key spring 34 inserted with a certain pretension. The pretension of key spring 34 insures that with the emergency key 30 not inserted, the key blade 31 abuts with a certain pressure by means of its stop nose 39 against the stop face 40 of housing half 37, whereby the front end of operating pin 32 does not project from key blade 31 at the front exit 42*a* of longitudinal bore 42 as can be clearly gathered from FIG. 6. This prevents any deformation during insertion. The axial displaceability of key blade 31 in key grip 33, i.e., in its housing half 37, resulting from the construction or arrangement of emergency key 30, provides, for the practical operation of emergency key 30 already explained relative to FIG. 5, the further displacement of key grip 33 on the wholly inserted key blade 31 which is necessary during the insertion process, whereby operating pin 32 participates in this further movement of key blade 31. Two threaded bores 43 constructed as blind holes serve to fix the covering half 44 of key grip 33 (cf. FIG. 7) to its housing half 37 by means of two fastening screws, provided that the part is made from metal.

FIG. 7 shows the covering half 44 of key grip 33 according to FIG. 6 dismantled from emergency key 30. An approximately semi-cylindrical recess 45 arranged on the inside of covering half 44 serves, like recess 41 of housing half 37 to receive key spring 34 constructed as a helical spring. Two countersunk through-bores 46 receive the two fastening screws constructed as countersunk screws for covering half 44, whereby their arrangement corresponds to the threaded bores 43 in housing half 37. To make the correct insertion position for emergency key 30 which is not constructed as a turning key immediately recognizable, housing half 37 and covering half 44 and therefore also the entire key grip 33 are constructed asymmetrically, i.e., with a grip portion 37*a* or 44*a* extended downwardly on one side, obviously corresponding to key groove 17 which always points downwards when the key is withdrawn. Recesses 36, 38/38*a* and 45 are preferably milled or cast in housing half 37 or covering half 44 of key grip 33, and the continuous planar surfaces 37*i* and 44*i* on the inside of both grip halves 37 and 44 are also cleanly milled and optionally surface ground so that no dust can penetrate the inside of key grip 33. As the depth of recess 38 in housing half 37 corresponds to the thickness of key blade 31, no recess in required in covering half 44 which also facilitates assembly of the mechanism in grip housing half 37.

FIG. 8 shows one of the two locking cylinders 10 according to FIG. 5 in plan view on the inside thereof and the end portion 13*a* of rotor 13 projecting inwardly from cylinder casing 12. The slot-like recess 25 of rotor 13 passing into vertical rotor end face 27 and which serves to receive coupling wing 3 or 3*a* not shown in FIG. 8 (cf. FIGS. 4 and 5) extends perpendicular to key groove 17 which with key 16 or emergency key 30 removed points downwards and forms a T with the latter on the inner rotor end face 27. FIG. 8 also shows the vertical end face 25*a* of recess 25 which forms the base thereof as well as lower pins 14 of the pairs of tumbler pins 14 and 15 projecting to the right and left into key groove 17 behind the same.

FIG. 9 is a three-dimensional view showing the recess 25 and its arrangement relative to key groove 17. Recess 25 milled in the rotor 13 on either side issues into its cylindrical peripheral surface so that the wall portion of bore 12*a* of cylindrical casing 12 for the rotary mounting of rotor 13 located in the vicinity of recess 25 is also visible in FIG. 8.

The previously described emergency key mechanism, while retaining emergency key 30 can also be used for locking cylinders 10 extended beyond the normal cylinder length L10 (e.g., 28 mm) and which for larger door thicknesses are, e.g., extended inwards on one side by 5, 10 or 20 mm. To enable on the one hand the axial displacement of coupling spindle 2 relative to normal key 16 and on the other of coupling wing 3*a* provided with operating member 9 relative to operating pin 32 of emergency key 30, it is merely necessary to have fixed or loosely insertible extension portions of a length corresponding to the particular cylinder length difference for operating the operating member 9 or loosely insertible extension portions of appropriate length for operating the rigid coupling spindle 2 as will be explained hereinafter relative to FIGS. 10 to 14.

FIG. 10 shows a locking cylinder 10*v* extended on one side which apart from the length difference constructionally only differs from the normal length cylinder 10 according to FIGS. 8 and 9 in that the extended rotor 13*v* is additionally provided with an axially directed cylindrical recess 46 which calculated from the base 25*a* of slot-like recess 25 rearwardly has a length corresponding to the extension value of cylinder 10*v*, is connected at the rear directly to the effective portion of key groove 17 and at the front issues at the vertical rotor end face 27. Recess 46 which is coaxial to the rotor longitudinal axis forms a vertical base 46*a* at the front end of the effective portion of key groove 17 and serves to receive a loosely insertible cylindrical flat axial extension portion 47 axially displaceable in the recess (cf. FIG. 12), whereby the length of said portion 47 also corresponds to the extension value of cylinder 10*v* or its rotor 13 so that the vertical front end face 47*a* of the axial extension portion 47 inserted in the cylindrical rotor recess 46 and engaging on the recess base 46*a* and the vertical end or base surface 25*a* of slot-like recess 25 are located in a common vertical plane.

Whereas in the case of cylinder 10 of normal length the inserted normal key 16 acts directly on the spindle head 5 of coupling spindle 2 and consequently directly displaces the latter as described hereinbefore relative to FIG. 4, in the present case the same normal key 16 presses on the rear end face of the inserted axial extension portion 47 and consequently indirectly displaces coupling spindle 2 via the latter, and therefore once again the whole of locking coupling 1 by its coupling path C (see FIG. 4). Despite the use of the normal key 16 which is actually too short for the extended cylinder 10*v*, on inserting the key locking coupling 1 is actuated in the same way as with normal cylinder 10. As the cylindrical recess issues at the front on the vertical rotor end face 27 which in any case results from its manufacture by milling, the axial extension portion 47 extending to the front over the recess base surface 25*a* during the insertion process is still adequately guided by the cylindrical recess.

FIG. 11 provides a three-dimensional view of cylinder 10v of FIG. 10 extended relative to the length L10 of normal cylinder 10 (cf. FIG. 9) by extension value V. Therefore, the extended cylinder 10v has a length $L10v = L10 + V$, as shown in FIG. 11. FIG. 11 clearly shows how the cylindrical recess 46 is positioned between the front slot-like recess 25 for coupling wing 3a and the rear effective portion of key groove 17. Instead of a single axial extension portion 47, it is also possible to provide two or several such portions successively in the cylindrical recess 46, e.g., two extension portions 47 each 5 mm long if the extended cylinder 10v is extended by extension value $V = 10$ mm relative to normal cylinder 10.

FIG. 12 shows the substantially cylindrical axial extension portion 47 in three-dimensional form. Its length is in each case selected in accordance with the extension value V of extended cylinder 10v, provided that extension portions of the same or different lengths, e.g., 5 and/or 10 mm are not arranged one behind the other. The axial extension portion 47 is uniformly flattened on one side so that on its underside a planar surface 47b is formed which is longitudinally parallel to axis A47. This serves to provide space in key groove 17 for an operating member extension to be explained relative to FIG. 13.

FIG. 13 shows a side view of an extended emergency-side coupling wing 3v. The extended operating member 9v of coupling wing 3v has an inwardly projecting prismatic attachment 49 serving as a fixed operating member extension and having a length selected in accordance with extension V of cylinder 10v or its rotor 13v according to FIG. 11. In this case, a rear end face 49a of operating member extension 49 serves for operating an operating member 9v by operating pin 32 which extends from key blade 31 on inserting emergency key 30. In FIG. 13, the extended coupling wing 3a in FIG. 5 is shown in its operating position in which the front end face 9a engages on cam web 23 and consequently again forms a longitudinal stop for the coupling wing 3v displaced to the left. coupling spindle 2 is here as in FIG. 5 displaced to the right by normal key 16 (not shown in FIG. 13) inserted as the opposite key in the left-hand opposite rotor 13, so that on inserting emergency key 30 into the right-hand rotor 13 the coupling wing 3v has covered its axial engaging path distance D to the left on stationary coupling spindle 2 (cf. FIGS. 13 and 5). So that the operating member extension 49, like the operating member 9v itself has adequate space in key groove 17 the cylindrical axial extension portion 47 is flattened on its underside, i.e., is provided with a planar surface 47b (cf. FIG. 12). The said portion 47 is loosely inserted in cylindrical recess 46 and located above the operating member extension 49 not shown in FIG. 13.

The operating member extension necessary for an extended locking cylinder can, according to FIG. 14, comprise a prismatic extension portion 50 loosely insertible in the key slot, whereby its length Lv corresponds to the extension value V of the cylinder (10 in FIG. 11) extended relative to the length L10 of the normal cylinder (10 in FIG. 9). In the same way as the axial extension 47 for the coupling spindle is formable by arranging axial extension portions of the same or different length in a row, this is correspondingly possible with the prismatic operating member extension 50 as indicated in FIG. 14 through the lengths Lv1 or Lv2 of two operating member extension portions arranged in a row and which can for example have a length of 10 mm in each case.

In the case of extended locking cylinders in place of the fixed or loose operating member extension in the emergency key used while maintaining the operating travel and operating pin length, it is also possible to provide a travel reserve for an operating travel increased corresponding to the extension value of the cylinder, whereby the axial displacement path of the key grip on the key blade would have to be increased corresponding to the extension stage of the cylinder and for constructional reasons possibly also the length of the key grip itself. Instead of only providing one of the two coupling wings of the locking coupling with an operating member, it is also possible to provide both coupling wings with an operating member, i.e., they are constructed completely identically when an emergency function is required on both sides e.g., for connecting doors between hotel rooms. Then one spindle head would be riveted to the coupling spindle only after inserting the locking coupling into the cam because then a previously assembled locking coupling could no longer be passed through the cam web opening due to the second operating slide. In the same way as the operating slide of the asymmetrical emergency-side coupling wing, i.e., provided on one side with a special coupling lug can be extended by a fixed extension attachment or at least a loose extension portion by a predetermined extension value corresponding to the extended locking cylinder, this is also possible in the case of the symmetrical emergency-side coupling wing which on coupling in the cam web engages in the web opening with its inner wing portion on either side of the coupling spindle over the entire wing width.

Therefore, the invention is not limited to the embodiments of the emergency key mechanism shown in the drawings, but details of the construction can be varied within the scope of the present invention.

The previously described emergency key mechanism has the essential advantage that it can also be subsequently provided without modifying the double locking cylinder, and also on changing the emergency status, e.g., on changing from an emergency function on one side to an emergency function on both sides, or for locking-technical reasons, it is no longer necessary to replace the entire cylinder. Furthermore, the hitherto necessary prior planning linked with the considerable uncertainties involved becomes superfluous because when using the emergency key mechanism according to the invention, it is constantly possible to adapt the locking system to the particular requirements without changing or replacing cylinders, whereby this is even possible during actual construction, whereby it need only be given the emergency function on one or both sides during the installation of the cylinder in the building. Thus, the installation of the components which are decisive for the emergency function need not take place till the last minute, whereby by means of the extremely simple fixed or loose extension portions provided on the emergency side coupling wing it is cheaply, easily and speedily possible to take account of cylinders extended on one side. Moreover, the emergency key mechanism according to this invention has the further advantage compared with the hitherto known corresponding mechanisms that it is no longer relatively easy for unauthorized persons to make the emergency key by filing down a normal key.

Now that the preferred embodiments of the invention have been described and illustrated, it must be understood that these are capable of variation and modification and it is not therefore desired to be limited to the precise details set forth but to include such modifications and alterations as fall within the scope of the appended claims.

What is claimed is:

1. In a cylinder lock of the type having two coaxial locking cylinders each having a stator portion and a rotor portion with a key slot, a lock bolt, and a lock bolt driver rotatably mounted between the rotor portions to operate the lock bolt when rotated, the lock bolt driver having a transverse web with means defining an opening therethrough, an improved emergency key operatable mechanism comprising a locking coupling including an axially displaceable coupling spindle having enlarged stop portions at the opposite ends thereof;

first and second coupling members mounted on said spindle, said members being rotatably and axially movable relative to each other and to said spindle, each of said members further being operatively associated with one of said rotor portions, each member being rotatable with and axially movable relative to its associated rotor portion, each of said members having a protruding portion thereof engageable with said opening in said lock bolt driver when said member and said spindle are axially displaced by insertion of a normal key of predetermined blade length in the key slot of its associated rotor portion; and compression spring means mounted on said spindle for urging said coupling members axially outwardly toward said enlarged portions on said spindle; and an emergency key insertable into the key slot of one of said rotor portions, said emergency key having a blade having a length shorter than said predetermined length of said normal key, and an operating pin extendable beyond the distal end of said blade when said emergency key is fully inserted in said slot;

the one of said coupling members operatively associated with said one of said rotor portions having a radially protruding portion engageable with said pin, said pin being operative to axially displace said one of said coupling members into engagement with said driver whereby said rotor and said driver can be rotated by said emergency key to operate the lock without axially displacing said spindle.

2. A mechanism according to claim 1 wherein said coupling members are substantially rectangular and constructed symmetrically relative to the coupling spindle and have portions engageable in said web opening extending at right angles to the coupling spindle over the entire member width when said members and said spindle are displaced as a unit, and wherein normal keys are used exclusively, the locking coupling as a whole is axially displaceable by a maximum of half the web width for the alternative coupling of its two coupling members in the driver, and wherein the emergency-side coupling member is axially displaceable relative to the coupling spindle by an engaging distance corresponding to a maximum of half the web width.

3. A mechanism according to claim 1, wherein said spring means is constructed as a compression spring and is mounted between said two coupling members and surrounds said coupling spindle.

4. A mechanism according to claim 1, wherein said two coupling members have recesses to permit movement thereof relative to the rotor mounting.

5. A mechanism according to claim 1, wherein for the emergency function on both sides of the double locking cylinder each of the two coupling members is provided with a radially protruding member engageable with an operating pin of said emergency key.

6. A mechanism according to claim 1 wherein each of said coupling members comprises a rectangular body on which said protruding portion comprises an axially projecting lug and wherein each of said coupling members further comprises a bore to receive said spindle, said lug extending toward said driver laterally of said bore, the axial length of said lug being substantially equal to the thickness of said web, and wherein said coupling members and said spindle are axially displaceable as a unit to permit said lugs to alternatively engage said web opening, and wherein said radially protruding portion of said one of said coupling members is a radial lug.

7. A mechanism according to claim 1 wherein said emergency key is a simple key which is not invertable and which further comprises a grip portion attached to and movable with said operating pin, said grip portion being axially movable relative to said emergency key blade, said operating pin being axially nondisplaceable relative to said grip portion;

compression spring means disposed between said blade and said grip portion for urging said grip portion and said pin toward a position in which said pin is retracted.

8. A mechanism according to claim 7 wherein the front end of the operating pin in the retracted position is recessed relative to the distal end of said emergency key blade, and wherein the key grip portion together with the operating pin is axially displaceable relative to the wholly inserted key blade for coupling the emergency-side coupling member in said web by an operating travel distance comprising the engagement distance of the emergency-side coupling member and the distance between the operating pin end and the distal end of said blade.

9. A mechanism according to claim 8, wherein the effective operating travel distance of the operating pin also includes a safety distance between the emergency-side spindle head of the whole locking coupling when said coupling is displaced to the emergency-side and the distal end of the blade of the wholly inserted emergency key.

10. A mechanism according to claim 7, wherein said key grip portion is in two parts, at least one of the two grip portion parts is provided with recesses for receiving said operating pin and said compression spring means.

* * * * *